US009091979B2

(12) United States Patent
Hayase

(10) Patent No.: US 9,091,979 B2
(45) Date of Patent: Jul. 28, 2015

(54) FIXING DEVICE AND IMAGE FORMING APPARATUS HAVING A FIXING BELT WHOSE ROTATION CENTER IS SHIFTED TOWARD A RECORDING-PAPER CONVEYANCE DIRECTION

(71) Applicant: KONICA MINOLTA, INC., Chiyoda-ku, Tokyo (JP)

(72) Inventor: Toru Hayase, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/268,680

(22) Filed: May 2, 2014

(65) Prior Publication Data

US 2014/0334857 A1 Nov. 13, 2014

(30) Foreign Application Priority Data

May 7, 2013 (JP) ..... 2013-097715

(51) Int. Cl.
*G03G 15/20* (2006.01)

(52) U.S. Cl.
CPC .... *G03G 15/2053* (2013.01); *G03G 2215/2025* (2013.01)

(58) Field of Classification Search
CPC ..... G03G 15/2053; G03G 2215/2025
USPC ..... 399/329
See application file for complete search history.

(56) References Cited

U.S. PATENT DOCUMENTS

| | | | | |
|---|---|---|---|---|
| 8,010,028 | B2 * | 8/2011 | Shinshi | 399/329 |
| 8,639,171 | B2 * | 1/2014 | Yonekawa et al. | 399/329 |
| 2010/0104307 | A1 | 4/2010 | Shinyama | |

FOREIGN PATENT DOCUMENTS

| | | | |
|---|---|---|---|
| JP | 2009-109997 | A | 5/2009 |
| JP | 2010-102126 | A | 5/2010 |
| JP | 2010-249917 | A | 11/2010 |
| JP | 2012-042772 | A | 3/2012 |

* cited by examiner

*Primary Examiner* — William J Royer
(74) *Attorney, Agent, or Firm* — Holtz, Holtz, Goodman & Chick PC

(57) ABSTRACT

A fixing device includes a rotatable fixing belt and a first fixing roller contacting an inner surface of the fixing belt. A second fixing roller contacts an outer surface of the fixing belt to hold the fixing belt against the first fixing roller to define a fixing nip region. An end restriction member supports ends of the fixing belt to restrict its rotation position. A support member is disposed at a position in the end restriction member to pivotally support the first fixing roller. The position is shifted with respect to a center position of the end restriction member corresponding to a rotation center of the fixing belt. The rotation center of the fixing belt is shifted toward a recording-paper conveyance direction of the fixing nip region with respect to a straight line connecting rotation centers of the first and second fixing rollers in a direction orthogonal to their rotation axes.

12 Claims, 11 Drawing Sheets

FIXING DEVICE AND IMAGE FORMING APPARATUS HAVING A FIXING BELT WHOSE ROTATION CENTER IS SHIFTED TOWARD A RECORDING-PAPER CONVEYANCE DIRECTION

CROSS-REFERENCE TO RELATED APPLICATIONS

The present application claims priority under 35 U.S.C. §119 to Japanese Patent Application No. 2013-097715, filed May 7, 2013. The contents of this application are incorporated herein by reference in their entirety.

BACKGROUND OF THE INVENTION

1. Field of the Invention

The present invention relates to a fixing device and an image forming apparatus.

2. Discussion of the Background

A conventional practice widely employed in electrographic image forming apparatuses is to convey a recording sheet of paper loaded with an unfixed toner image into a fixing nip region defined between a heater to be heated by a heat source and a pressurizer in contact with the heater. The recording sheet of paper is heated and pressed in the fixing nip region so as to fix the unfixed toner image to the recording sheet of paper. The heater for this kind of fixing device uses a thin heat generating member such as a heat generating belt, considering that the thin heat generating member has a small heat capacity, is capable of heating up in a short time, and consumes less energy.

An example of the heat generating source for the heat generating belt is a resistance heating element. The resistance heating element implements Joule heating upon establishment of electrical continuity. Japanese Unexamined Patent Application Publication No. 2009-109997 discloses a fixing device made up of this resistance heating element as a heat generation source and a heater. The heater includes a press roller (fixing roller) that has an outer diameter smaller than the inner diameter of a circumferentially driven endless fixing belt (heat generating belt), and that is loosely fitted to the inside of the fixing belt. The fixing device disclosed in Japanese Unexamined Patent Application Publication No. 2009-109997 has what is called a "clearance fit configuration", that is, the press roller inside the fixing belt is pressed by a pressure roller from outside the fixing belt so as to define a fixing nip.

With the fixing device of Japanese Unexamined Patent Application Publication No. 2009-109997, the fixing belt comes into contact with the press roller on the upstream side of the fixing nip region in a recording-paper conveyance direction (inlet side of the fixing nip region). On the downstream side of the fixing nip region in the recording-paper conveyance direction (outlet side of the fixing nip region), the recording sheet of paper is heated under low pressure. This can cause poor image quality, such as uneven brightness, of the image after subjected to fixing. Additionally, the inclination angle (separation angle) of the fixing belt on the outlet side of the fixing nip region is small, and this can cause poor separatability of the recording sheet of paper past the fixing nip region.

The present invention has been made in view of the above-described circumstances, and it is an object of the present invention to provide a fixing device and an image forming apparatus including the fixing device. The fixing device provides satisfactory separatability of a recording sheet of paper after subjected to toner image fixing, and consumes less energy.

SUMMARY OF THE INVENTION

According to one aspect of the present invention, a fixing device includes a rotatable fixing belt, a first fixing roller, a second fixing roller, an end restriction member, and a support member. The first fixing roller is in internal contact with an inner surface of the fixing belt. The first fixing roller has an outer diameter smaller than an inner diameter of the fixing belt. The second fixing roller is in external contact with an outer surface of the fixing belt. The second fixing roller holds the fixing belt against the first fixing roller so as to define a fixing nip region between the first fixing roller and the second fixing roller. The end restriction member supports ends of the fixing belt so as to restrict a rotation position of the fixing belt. The support member is disposed at a position in the end restriction member to pivotally support the first fixing roller. The position is shifted with respect to a center position of the end restriction member corresponding to a rotation center of the fixing belt. The rotation center of the fixing belt is shifted toward a recording-paper conveyance direction of the fixing nip region with respect to a straight line connecting a rotation center of the first fixing roller and a rotation center of the second fixing roller to each other in a direction orthogonal to a rotation axis of the first fixing roller and a rotation axis of the second fixing roller.

According to another aspect of the present invention, an image forming apparatus includes a transfer unit and a fixing unit. The transfer unit is configured to transfer a toner image onto a recording sheet of paper. The fixing unit is configured to heat and press the recording sheet of paper with the toner image transferred to the recording sheet of paper by the transfer unit. The fixing unit includes the above-described fixing device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
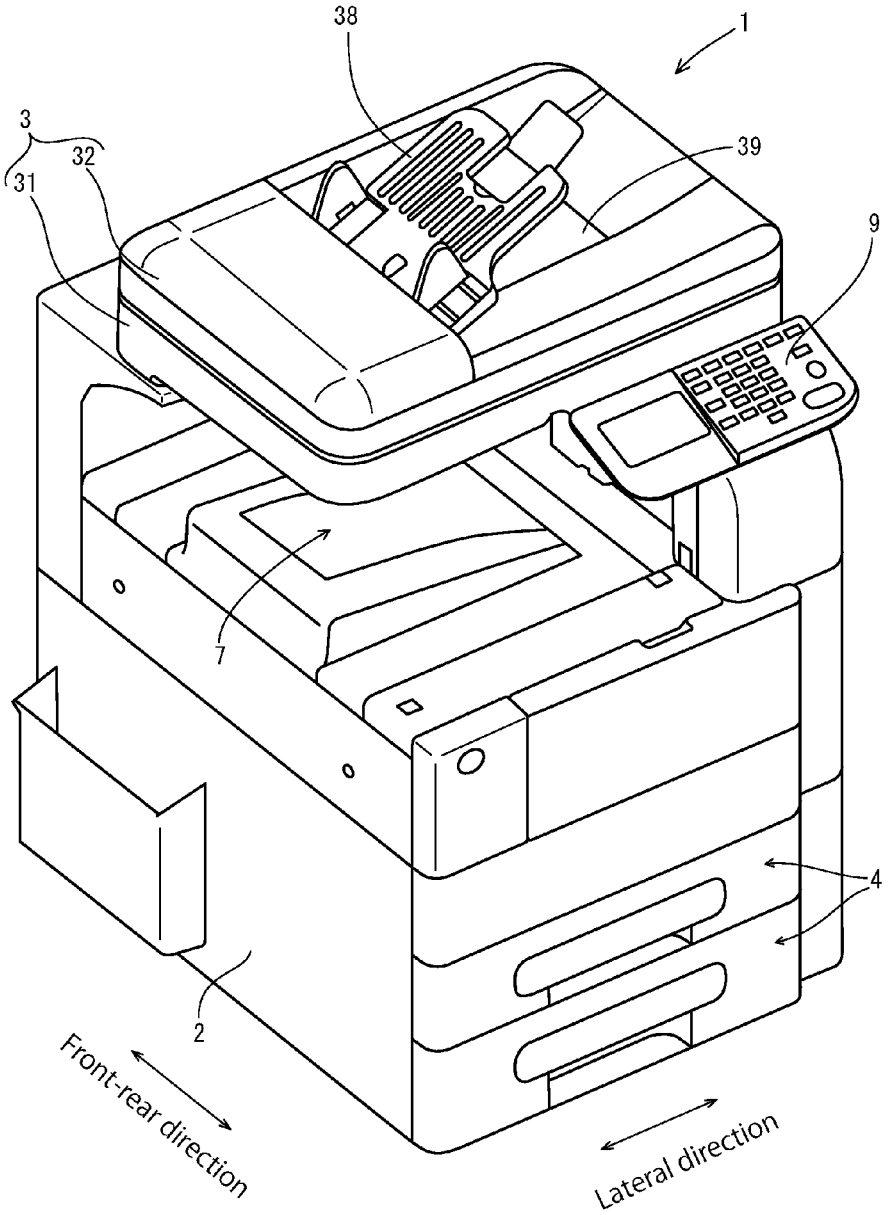
FIG. 1 is an external perspective view of an image forming apparatus according to an embodiment.

The embodiments will now be described with reference to the accompanying drawings, wherein like reference numerals designate corresponding or identical elements throughout the various drawings.

Figure 2:
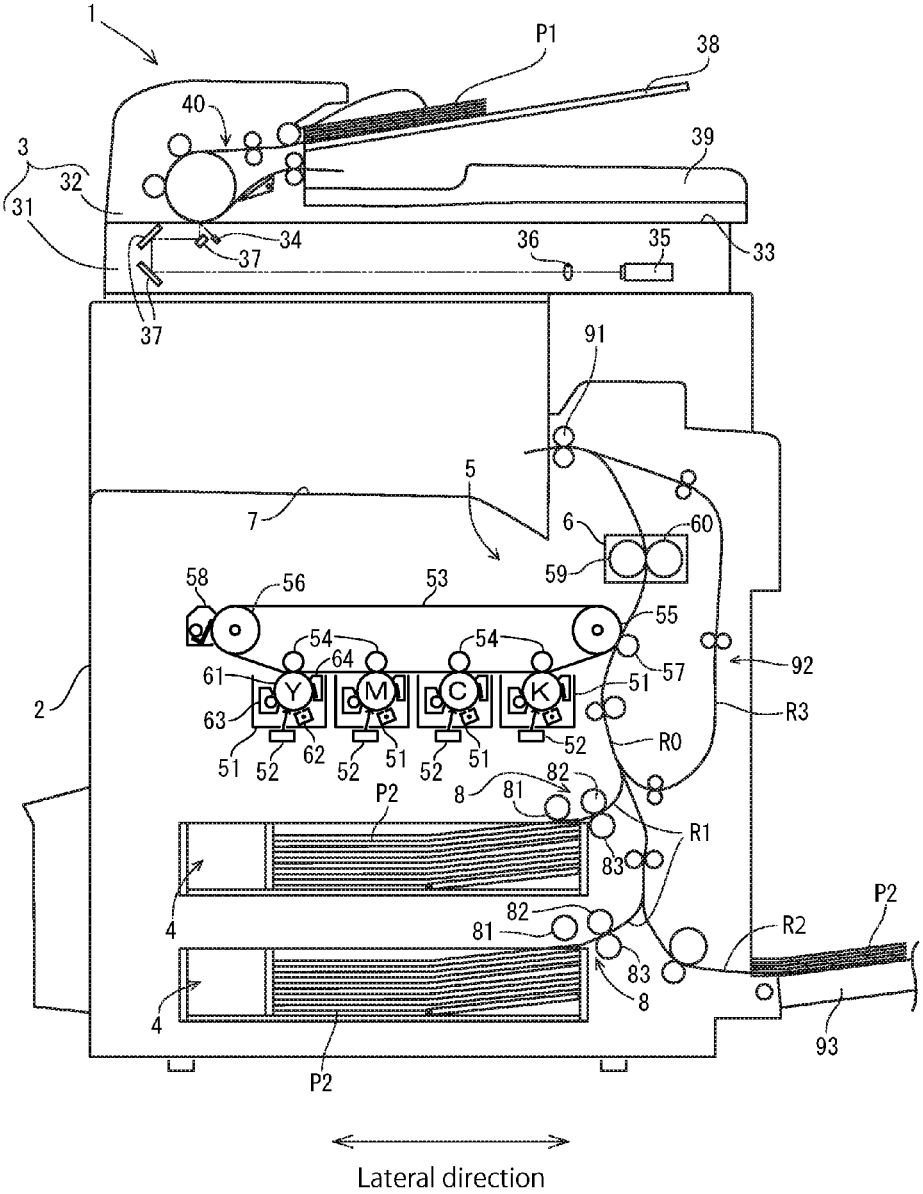
FIG. 2 is a block schematic diagram illustrating an internal configuration of the image forming apparatus shown in FIG. 1.

In the following description, terms (for example, "left and right" and "upper and lower") indicating specific directions and positions are used where necessary. In this respect, the direction perpendicular to the paper plane of FIG. 2 is defined as front view. The terms are used for the sake of description and not intended to limit the technical scope of the present invention.

<General Arrangement of Image Forming Apparatus>

A general arrangement of the image forming apparatus common to the following individual embodiments will be described below with reference to the drawings. FIG. 1 is an external perspective view of an image forming apparatus according to an embodiment. FIG. 2 is a schematic diagram illustrating an internal configuration of the image forming apparatus.

As shown in FIGS. 1 and 2, an image forming apparatus 1 includes an image reading unit 3, paper feed trays 4, a transfer unit 5, a fixing unit 6, a paper discharge tray 7, and an operation panel 9. The image reading unit 3 reads an image from an original document P1. The paper feed trays 4 store recording sheets of paper P2 on which an image is to be formed. The transfer unit 5 transfers a toner image to a recording sheet of paper P2 conveyed from the paper feed trays 4. The fixing unit 6 fixes the toner image transferred by the transfer unit 5 onto the recording sheet of paper P2. The paper discharge tray 7 accepts a discharge of the recording sheet of paper P2 loaded with an image fixed by the fixing unit 6. The operation panel 9 accepts an operation to the image forming apparatus 1. The image reading unit 3 is disposed above an apparatus body 2 of the image forming apparatus 1, and the transfer unit 5 is disposed below the image reading unit 3.

The paper discharge tray 7 is disposed above the transfer unit 5 in the apparatus body 2 so as to receive the recording sheet of paper P2 discharged after subjected to image recording at the transfer unit 5 and the fixing unit 6. The paper feed trays 4 are detachably disposed below the transfer unit 5 in the apparatus body 2. With this configuration, as described later, the recording sheet of paper P2 stored in the paper feed trays 4 is conveyed into the apparatus body 2. Then, while the recording sheet of paper P2 is conveyed upward, an image is transferred onto the recording sheet of paper P2 by the transfer unit 5, which is disposed above the paper feed trays 4, and the image is fixed by the fixing unit 6. Then, the recording sheet of paper P2 is discharged onto the paper discharge tray 7, which is disposed in the space (recessed space) defined by the image reading unit 3 and the transfer unit 5.

The image reading unit 3, which is disposed above the apparatus body 2, includes a scanner section 31 and an auto document feeder (ADF) 32. The scanner section 31 reads images from the original document P1. The auto document feeder 32 is disposed above the scanner section 31 and conveys one original document P1 at a time to the scanner section 31. The operation panel 9 is disposed on the front side (front surface) of the apparatus body 2. On the operation panel 9, a user performs key operations while looking at the display screen or other elements on the operation panel 9 so as to perform various settings for a function selected from the functions of the image processing apparatus 1, and to instruct the image forming apparatus 1 to execute an operation.

Referring to FIG. 2, an internal structure of the apparatus body 2 will be described. The scanner section 31 of the image reading unit 3, which is disposed above the apparatus body 2, includes an original document table 33, a light source section 34, an image sensor 35, an imaging lens 36, and a mirror group 37. The original document table 33 includes a platen glass (not shown) on the upper surface of the original document table 33. The light source section 34 irradiates light to the original document P1. The image sensor 35 photoelectrically converts reflected light from the original document P1 into image data. The imaging lens 36 images the reflected light onto the image sensor 35. The mirror group 37 sequentially reflects the reflected light from the original document P1 so as to make the reflected light incident on the imaging lens 36. The light source section 34, the image sensor 35, the imaging lens 36, and the mirror group 37 are disposed inside the original document table 33. The light source section 34 and the mirror group 37 are laterally movable with respect to the original document table 33.

The ADF 32 is disposed on the upper surface side of the scanner section 31 and is openable/closable with respect to the original document table 33. The ADF 32 also has a function of overlying the original document P1 on the platen glass (not shown) of the original document table 33 so as to keep the original document P1 in close contact with the platen glass (not shown). The ADF 32 includes an original document mounting tray 38 and an original document discharge tray 39.

When the image reading unit 3 thus configured reads the original document P1 on the platen glass (not shown) of the original document table 33, light is irradiated to the original document P1 from the light source section 34 moving in the right direction (sub-scanning direction). The reflected light reflected from the original document P1 is sequentially reflected from the mirror group 37 moving in the right direction similarly to the light source section 34. Thus, the reflected light is incident on the imaging lens 36 and imaged on the image sensor 35. The image sensor 35 performs photoelectric conversion on a pixel basis according to the intensity of the incident light so as to generate an image signal (RGB signal) corresponding to the image of the original document P1.

When the image reading unit 3 reads the original document P1 mounted on the original document mounting tray 38, the original document P1 is conveyed to a reading position by an original document conveyance mechanism 40. The original document conveyance mechanism 40 is made up of a plurality of rollers and other elements. Here, the light source section 34 and the mirror group 37 of the scanner section 31 are fixed at predetermined positions in the original document table 33. Thus, light is irradiated from the light source section 34 to a reading position of the original document P1, and light reflected from the original document P1 is formed into an image on the image sensor 35 via the mirror group 37 and the imaging lens 36 of the scanner section 31. Then, the image sensor 35 converts the image into an image signal (RGB signal) corresponding to the image of the original document P1. Then, the original document P1 is discharged onto the original document discharge tray 39.

The transfer unit 5 transfers a toner image onto a recording sheet of paper P2, and includes image forming sections 51, exposure sections 52, an intermediate transfer belt 53, primary transfer rollers 54, a driving roller 55, a driven roller 56, a secondary transfer roller 57, and a cleaner section 58. The image forming sections 51 respectively generate toner images of colors Y (Yellow), M (Magenta), C (Cyan), and K (Key tone). The exposure sections 52 are respectively disposed below the image forming sections 51. The intermediate transfer belt 53 is brought into contact with the image forming sections 51 for the respective colors arranged in a horizontal direction so that the respective color toner images are transferred from the image forming sections 51 to the intermediate transfer belt 53. The primary transfer rollers 54 are respectively disposed at positions above and opposed to the corresponding image forming sections 51 for the respective colors as if to hold the intermediate transfer belt 53 between the image forming sections 51 and the intermediate transfer belt 53. The driving roller 55 drives the intermediate transfer belt 53. The driven roller 56 rotates upon transmission of the rotation of the driving roller 55 through the intermediate transfer belt 53. The secondary transfer roller 57 is disposed at a position opposed to the driving roller 55 with the intermediate transfer belt 53 held between the driving roller 55 and the secondary transfer roller 57. The cleaner section 58 is disposed at a position opposed to the driven roller 56 with the intermediate transfer belt 53 held between the driven roller 56 and the cleaner section 58.

Each of the image forming sections 51 includes a photoreceptor drum 61, a charger 62, a developer 63, and a cleaner section 64. The photoreceptor drum 61 is in contact with an outer surface of the intermediate transfer belt 53. The charger 62 charges the outer surface of the photoreceptor drum 61 by corona discharge. The developer 63 adhere toner charged by stirring to the outer surface of the photoreceptor drum 61. The cleaner section 64 removes the toner remaining on the outer surface of the photoreceptor drum 61 after the toner image is transferred to the intermediate transfer belt 53. Here, the photoreceptor drum 61 is disposed at a position opposed to the primary transfer roller 54 with the intermediate transfer belt 53 held between the primary transfer roller 54 and the photoreceptor drum 61, and rotates clockwise in FIG. 2. The primary transfer roller 54, the cleaner section 64, the charger 62, the exposure section 52, and the developer 63 are disposed in this order around the photoreceptor drum 61 along the rotation direction of the photoreceptor drum 61.

An example of the intermediate transfer belt 53 is a conductive endless belt member looped across the driving roller 55 and the driven roller 56 without looseness. This enables the intermediate transfer belt 53 to rotate counterclockwise in FIG. 2 in conjunction with the rotation of the driving roller 55. The secondary transfer roller 57, the cleaner section 58, and the image forming sections 51 for the respective colors YMCK are disposed in this order around the intermediate transfer belt 53 along the rotation direction of the intermediate transfer belt 53.

The fixing unit 6 fixes the toner image transferred to the recording sheet of paper P2, and includes a heater 59 and a pressurizer 60. The heater 59 provides heat to fix the toner image on the recording sheet of paper P2. The pressurizer 60 holds the recording sheet of paper P2 together with the heater 59 so as to press the recording sheet of paper P2.

A paper feed mechanism 8 includes a pick-up roller 81 and a pair of separation rollers. The pick-up roller 81 picks up uppermost recording sheets of paper P2 from among the recording sheets of paper P2 stored in the paper feed trays 4. The pair of separation rollers are made up of a paper feed roller 82 and a separation roller 83 to separate the delivered recording sheets of paper P2 into a recording sheet of paper P2. From each paper feed tray 4, the uppermost recording sheets of paper P2 are conveyed, one at a time, toward a main conveyance passage R0 via paper feed passages R1 by rotational driving of the corresponding pick-up roller 81, paper feed roller 82, and separation roller 83. The main conveyance passage R0 is a main passage for the recording sheets of paper P2 to be subjected to the process of image forming (printing). The paper feed passages R1 correspond to the respective paper feed trays 4, and are joined to the main conveyance passage R0.

At one side in the lateral direction of the apparatus body 2 (at the right side in this embodiment), a manual paper feed tray 93 is disposed. The manual paper feed tray 93 is used to externally feed recording sheets of paper P2 of a predetermined size. The manual paper feed tray 93 is an auxiliary tray in addition to the usual paper feed trays 4, which are disposed inside the apparatus body 2, and is rotatable into open or closed state with respect to the one side in the lateral direction of the apparatus body 2. On the manual paper feed tray 93, recording sheets of paper P2 are disposed, and uppermost recording sheets of paper P2 are conveyed, one at a time, toward the main conveyance passage R0 via a manual paper feed passage R2 by rotational driving of a pick-up roller and other rollers.

A pair of paper discharge rollers 91 are disposed on the main conveyance passage R0 at a further downstream position than the fixing unit 6, which is made up of the heater 59 and the pressurizer 60. The pair of paper discharge rollers 91 discharge the recording sheet of paper P2 after subjected to printing. The recording sheet of paper P2 after subjected to printing is discharged onto the paper discharge tray 7 by the rotational driving of the pair of paper discharge rollers 91.

The components of the apparatus body 2 of the image forming apparatus 1 are configured as described above. In such apparatus body 2, a circulation conveyance section 92 is disposed. The circulation conveyance section 92 turns over the recording sheet of paper P2 after subjected to simplex printing so as to subject the recording sheet of paper P2 to duplex printing. The circulation conveyance section 92 includes: a pair of reversing rollers to turn over the recording sheet of paper P2 after subjected to simplex printing; and a plurality of pairs of duplex conveyance rollers. After simplex printing, the circulation conveyance section 92 turns over the recording sheet of paper P2 so as to convey the recording sheet of paper P2 again to the main conveyance passage R0 via a circulation conveyance passage R3. In this case, the pair of paper discharge rollers 91 are capable of rotating forward and backward, that is, the pair of paper discharge rollers 91 has another function to serve as a pair of reversing rollers. The forward and backward rotation of the pair of paper discharge rollers 91 ensures that the recording sheet of paper P2 is discharged to the outside of the image forming apparatus 1 and is switched back (conveyed backward) to the inside of the image forming apparatus 1. The upstream side of the circulation conveyance passage R3 is branched from the main conveyance passage R0 between the fixing unit 6 and the pair of paper discharge rollers 91. The downstream side of the circulation conveyance passage R3 is joined to the upstream side of the transfer unit 5.

A printing operation by the image forming apparatus 1 will be described briefly. The image forming apparatus 1 starts its printing operation upon receipt of a start signal, an image signal, or another signal. Upon start of the printing operation, a recording sheet of paper P2 is picked up from the paper feed tray 4 by the paper feed mechanism 8, and conveyed to the transfer unit 5 along the main convenience passage R0. The transfer unit 5 and the fixing unit 6 respectively perform transfer and fixing of an image to the recording sheet of paper P2 based on color electrophotography. The method of image transfer to the recording sheet of paper P2 employed here is an intermediate transfer method using the intermediate transfer belt 53.

Here, in the image forming sections 51 for YMCK colors in the transfer unit 5, a laser beam is irradiated from the exposure section 52 to the surface of the photoreceptor drum 61 charged by the charger 62 so as to form electrostatic latent images corresponding to the images of colors Y, M, C, and K. The toner charged by the developer 63 is transferred to the surface of the photoreceptor drum 61 loaded with the electrostatic latent image, and thus a toner image is formed on the photoreceptor drum 61. Then, when the toner image carried on the surface of the photoreceptor drum 61 is brought into contact with the intermediate transfer belt 53, the toner image is transferred to the intermediate transfer belt 53 by electrostatic force of the primary transfer roller 54. Consequently, the toner images of the respective colors Y, M, C, and K overlapped with each other are formed on the surface of the intermediate transfer belt 53. In the meantime, untransferred toner remaining on the photoreceptor drum 61 after the toner image has been transferred to the intermediate transfer belt 53 is scraped off by the cleaner section 64 and removed from the surface of the photoreceptor drum 61.

Upon rotation of the intermediate transfer belt 53 by the driving roller 55 and the driven roller 56, the toner image transferred to the intermediate transfer belt 53 is moved to a transfer position at which to contact with the secondary transfer roller 57. Here, the toner image is transferred to the recording sheet of paper P2 that has been conveyed to the transfer position on the main conveyance passage R0. In the meantime, untransferred toner remaining on the intermediate transfer belt 53 from which the toner image has been transferred to the recording sheet of paper P2 is scraped off by the cleaner section 58 and removed from the surface of the intermediate transfer belt 53. The recording sheet of paper P2 loaded with the toner image transferred at the contact position with the secondary transfer roller 57 is conveyed to the fixing unit 6, which is made up of the heater 59 and the pressurizer 60.

The recording sheet of paper P2 loaded with the unfixed toner image on one surface passes through the fixing position of the fixing unit 6. Here, the recording sheet of paper P2 is heated by the heater 59 and pressed by the pressurizer 60, and thus the unfixed toner image is fixed to the paper surface. In the case of simplex printing, the recording sheet of paper P2 loaded with the fixed toner image (after simplex printing) is discharged onto the paper discharge tray 7 through the pair of paper discharge rollers 91. In the case of duplex printing, the recording sheet of paper P2 after subjected to simplex printing is conveyed to the circulation conveyance passage R3 for duplex printing, where the recording sheet of paper P2 is turned over and returned to the main conveyance passage R0. While the recording sheet of paper P2 is passing through the transfer unit 5 and the fixing unit 6, a toner image is transferred and fixed to the other surface of the recording sheet of paper P2. Then, the recording sheet of paper P2 is discharged onto the paper discharge tray 7.

This configuration of the image forming apparatus 1 is common to the image forming apparatuses according to the following embodiments. A difference is the configuration of a fixing device serving as the fixing unit 6 in each image forming apparatus 1. In view of this, the following description is regarding a detailed configuration of the fixing device used as the fixing unit 6 in the image forming apparatus 1.

<First Embodiment>

Figure 3:
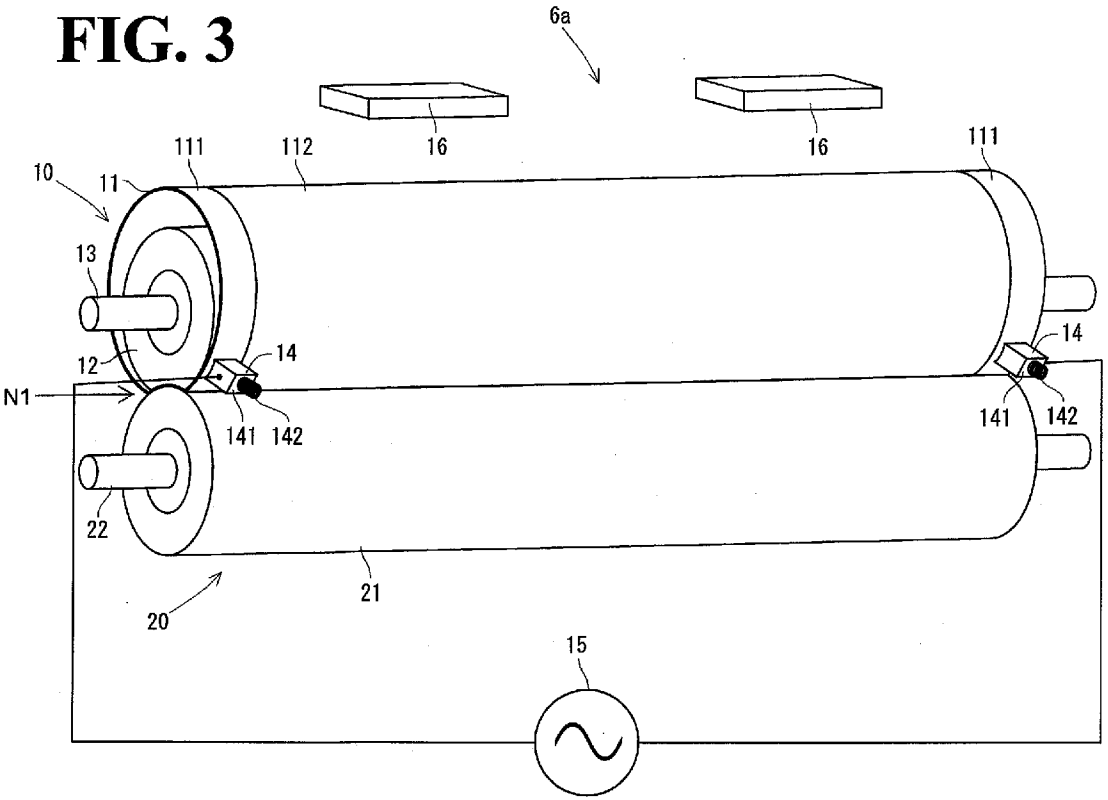
FIG. 3 is a schematic perspective view of a fixing device in an image forming apparatus according to a first embodiment.
Figure 4:
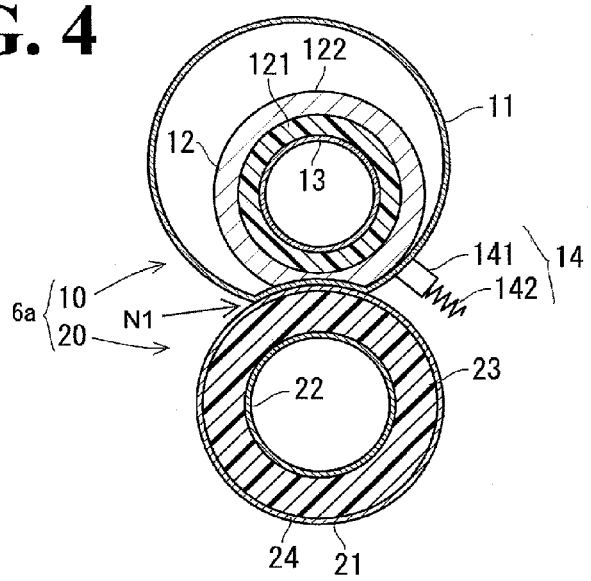
FIG. 4 is a schematic cross-sectional view of the fixing device shown in FIG. 3.
Figure 5:
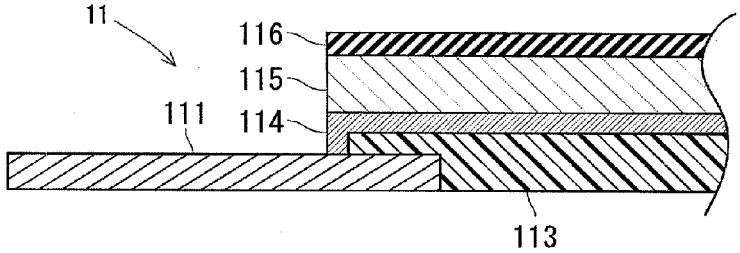
FIG. 5 is a schematic cross-sectional view of a heat generating belt in the fixing device shown in FIG. 3.
Figure 6:
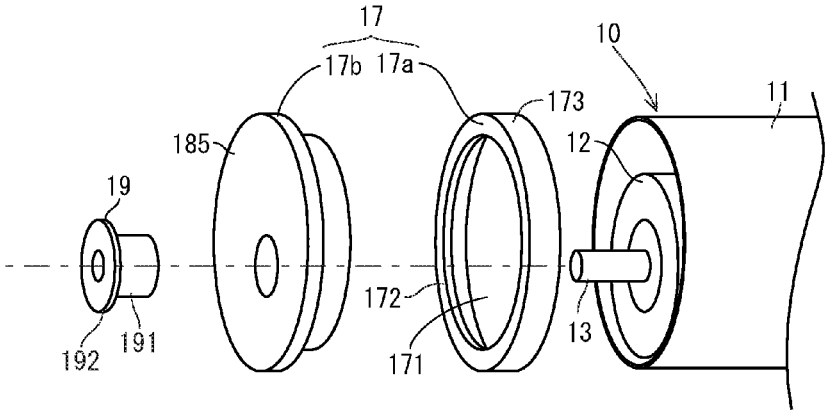
FIG. 6 is an exploded perspective view of an end portion of a heater in the fixing device shown in FIG. 3.
Figure 7:
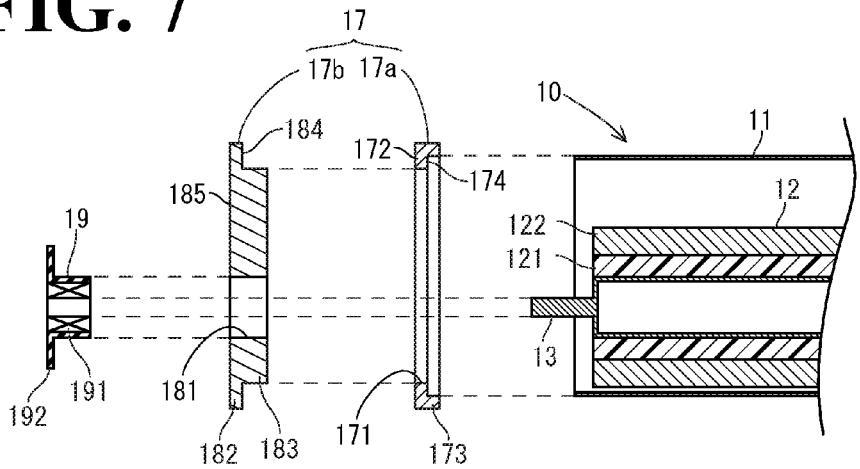
FIG. 7 is a schematic cross-sectional view of the end portion of the heater shown in FIG. 6.

The image forming apparatus according to a first embodiment will be described below with reference to the drawings, with the configuration of the fixing device in focus. FIG. 3 is a schematic diagram illustrating a configuration of the fixing device in the image forming apparatus according to this embodiment. FIG. 4 is a schematic cross-sectional view of the fixing device. FIG. 5 is a partial cross-sectional view of a heat generating belt in the fixing device shown in FIG. 3. FIG. 6 is an exploded perspective view of an end portion of a heater in the fixing device shown in FIG. 3. FIG. 7 is a schematic cross-sectional view of the end portion of the heater.

As shown in FIGS. 3 and a fixing device **6*a* according to this embodiment includes a heater 10 and a pressurizer 20. The heater 10 includes a heat generating belt 11 and a fixing roller 12. The heat generating belt 11 is an endless belt. The fixing roller 12 drives the heat generating belt 11 into circumferential rotation. The pressurizer 20 includes a pressure roller 21. The pressure roller 21 presses the fixing roller 12 via the heat generating belt 11, and uses a cylindrical core 22 as a shaft core. The heater 10 and the pressurizer 20 respectively correspond to the heater 59 and the pressurizer 60 in the foregoing image forming apparatus 1 (see FIGS. 1 and 2). The heat generating belt 11 corresponds to the "fixing belt" recited in the appended claims. The fixing roller 12 and the pressure roller 21** respectively correspond to the "first fixing roller" and the "second fixing roller" recited in the appended claims.

The pressurizer 10 includes the heat generating belt 11, the fixing roller 12, two power feed members 14, a power supply 15, and a temperature detection section 16. The heat generating belt 11 is provided with electrodes 111 at both end portions of the heat generating belt 11. The fixing roller 12 is disposed inside the heat generating belt 11 and uses a cylindrical core 13 as a shaft core. The two power feed members 14 are respectively in contact with the electrodes 111 at both ends of the heat generating belt 11. The power supply 15 is electrically coupled to the two power feed members 14. The temperature detection section 16 includes, for example, a thermopile to detect a surface temperature of the heat generating belt 11. The pressurizer 20 includes the pressure roller 21. The pressure roller 21 and the fixing roller 12 hold the heat generating belt 11 between the pressure roller 21 and the fixing roller 12. The region of the heat generating belt 11 under pressure between the pressure roller 21 and the fixing roller 12 is a fixing nip region.

A region 112 of the heat generating belt 11 of the heater 10 that extends between the electrodes 111 at both end portions of the heat generating belt 11 defines a fixing nip region N1. The fixing nip region N1 is to be brought into contact with the pressure roller 21. As shown in FIG. 5, the heat generating belt 11 includes a resistance heating element layer 113, a reinforcement layer 114, an elastic layer 115, and a release layer 116, which are sequentially laminated in the region 112 from inside to outside of the region 112. The resistance heating element layer 113 partially covers the outer surface of each of the electrodes 111 at both end portions of the heat generating belt 11. Both ends of the resistance heating element layer 113 are covered with the reinforcement layer 114 on the outside of the electrodes 111. Thus, the electrodes 111 at both ends of the heat generating belt 11 are electrically coupled to each other via the resistance heating element layer 113.

In the heat generating belt 11 thus configured, the electrodes 111 are made of a conductive material of metal, such as copper, aluminum, nickel, brass, and phosphor bronze. Preferable examples of the conductive material for the electrodes 111 include nickel, stainless steel, and aluminum, which have low electrical resistivity and excel in heat resistance and oxidation resistance. The thickness of each of the electrodes 111 is preferably 20 μm to 80 μm.

The resistance heating element layer 113, which is electrically coupled to the electrodes 111, contains the conductive material dispersed into an insulating material such as heat resistant resin. Adjusting the content of the conductive material adjusts the volume resistivity of the resistance heating element layer 113. Thus, upon receipt of power supply via the electrodes 111, the resistance heating element layer 113 generates Joule heat based on the volume resistivity of the resistance heating element layer 113 so as to generate heat. While the thickness of the resistance heating element layer 113 may be determined conveniently, 30 μm to 150 μm is preferred. The volume resistivity of the resistance heating element layer 113 is preferably approximately $1.0\times10^{-6}$ to $1.0\times10^{-2}$ Ω·m, more preferably approximately $1.0\times10^{-5}$ to $5.0\times10^{-3}$ Ω·m.

Examples of the heat resistant resin for the resistance heating element layer 113 include polyimide resin, polyethylene sulfide resin, polyether ether ketone resin, polyamide resin, polysulfone resin, polyimide-amide resin, polyester imide resin, polyphenylene oxide resin, poly-p-xylene resin, and polybenzimidazole resin. In particular, polyimide resin is preferred considering high heat resistance. Examples of the conductive material for the resistance heating element layer 113 include metal powder of silver, copper, aluminum, magnesium, and nickel, and carbon compound powder of carbon nanotube, carbon nanofiber, and carbon nanocoil. It is also possible to use a mixture of two or more kinds of conductive materials. The conductive material preferably has a fibrous shape in order to increase the contact probability between materials and equalize electrical resistance with a small content of the conductive material. When carbon compound powder is used, its volume fraction is preferably 40 vol % to 50 vol %.

The resistance heating element layer 113 is prepared in the following exemplary manner. First, powder of a conductive material is uniformly dispersed in a polyimide solution (polyimide varnish) obtained by polymerizing aromatic tetracarboxylic dianhydride and aromatic diamine in an organic solvent. Then, the polyimide solution in which the conductive material is dispersed is applied to a die and then subjected to imide conversion. Thus, the resistance heating element layer 113 is formed. Here, in consideration of preparation stability, it is possible to mix imidizing agent, coupling agent, surface active agent, antifoaming agent, or another agent into the polyimide solution. In order to adjust the electrical resistivity of the resistance heating element layer 113, the resistance heating element layer 113 may contain a suitable amount of conductive particles such as of metal alloy and intermetallic compound. In order to improve the mechanical strength of the resistance heating element layer 113, the resistance heating element layer 113 may contain, for example, glass fiber, whisker, titanium oxide, and potassium titanate. In order to improve the heat transfer coefficient of the resistance heating element layer 113, the resistance heating element layer 113 may contain, for example, aluminum nitride and alumina.

The reinforcement layer 114 covers the outer surface of the resistance heating element layer 113, whose strength is lowered by containing the conductive material, so as to reinforce the resistance heating element layer 113. The reinforcement layer 114 is made of an insulating layer of insulating material with some heat resistance. As the insulating material, it is possible to use the same kind of resin as the resin of the resistance heating element layer 113. This ensures adhesivity with the resistance heating element layer 113. The thickness of the resistance heating element layer 113 is preferably approximately 5 μm to 100 μm. The insulating material for the reinforcement layer 114 may be a resin material different from the resin material of the resistance heating element layer 113. When the resistance heating element layer 113 has sufficient strength, it is possible to omit the reinforcement layer 114.

The elastic layer 115 is a layer to cover the outer surface of the reinforcement layer 114 or the outer surface of the resistance heating element layer 113. The elastic layer 115 is made of a rubber material with high heat resistance, such as silicone rubber and fluoro rubber. The thickness of the elastic layer 115 is preferably in the range of 10 μm to 800 μm, and more preferably 100 μm to 300 μm. When the elastic layer 115 has a thickness of equal to or more than 10μm, sufficient elasticity in the thickness direction is obtained. When the elastic layer 115 has a thickness of equal to or less than 800 μm, it is easy to make the heat generated in the resistance heating element layer 113 reach the outer surface of the heat generating belt 11, thus ensuring satisfactory heat transfer efficiency. Providing the elastic layer 115 eliminates or minimizes uneven brightness of a color image formed on the recording sheet of paper P2.

The release layer 116 is an outermost layer of the heat generating belt 11 to cover the outer surface of the elastic layer 115. The release layer 116 is a layer to enhance releasability between the heat generating belt 11 and the recording sheet of paper P2. As the material for the release layer 116, it is possible to use a material that is durable against use at fixing temperatures and has excellent releasability against toner. The release layer 116 is made of a fluorine-based tube or fluorine-based coating of fluororesin, such as PFA (tetrafluoro-ethylene-perfluoro alkoxy ethylene copolymer), PTFE (trafluoroethylene), FEP (trafluoroethylene-hexafluoroethylene copolymer), and PFEP (tetrafluoroethylene-hexafluoropropylene copolymer).

The release layer 116 may be made of a conductive material, considering that the elastic layer 115 is interposed between the release layer 116, and the resistance heating element layer 113 and the electrode 111. The thickness of the release layer 116 is preferably in the range of 5 μm to 100 μm, more preferably 10 μm to 50 μm. The fluororesin material used for the release layer 116 has a surface contact angle with water of preferably equal to or more than 90°, more preferably equal to or more than 110°. The fluororesin material preferably has a surface roughness Ra (arithmetic mean roughness) of 0.01 μm to 50 μm.

As shown in FIGS. 3 and 4, the power feed members 14, which are in contact with the electrodes 111 of the heat generating belt 11, are disposed at positions that are located on the outer circumferential side of the heat generating belt 11 and are located on the downstream side in the conveyance direction of the recording sheet of paper P2 with respect to the fixing nip region N1, which is to come into contact with the pressure roller 21. That is, the tips of power feed brushes 141 of the power feed members 14 are in contact with the outer surfaces of the electrodes 111 on both ends of the heat generating belt 11 on the downstream side of the fixing nip region N1 along the circumferential rotation direction of the heat generating belt 11 (that is, in a region corresponding to the vicinity of the lowermost part of a rotation passage of the heat generating belt 11). The power feed brushes 141 are each made of a carbon brush such as of copper graphite and carbon graphite. The width of each of the power feed brushes 141 along the axial direction of the heat generating belt 11 is narrower than the width of each of the electrodes 111.

Each of the power feed members 14 includes a bias member 142 to press the power feed brush 141 in the inward direction of the circumferential rotation passage of the heat generating belt 11. An example of the bias member 142 is a compression spring. The pressing force of the bias member 142 satisfactorily maintains the contact state between the electrode 111 and the power feed brush 141 so as to satisfactorily maintain the electrical connection state between the electrode 111 and the power feed brush 141. The length of the power feed brush 141 in the circumferential rotation direction of the heat generating belt 11 is set within such a range that the contact area of the power feed brush 141 with the electrode 111 does not exceed the allowable current density of the power feed brush 141. The surface of the power feed brush 141 in contact with the electrode 111 may have a shape along the curved surface of the heat generating belt 11. This increases the contact area and decreases current density.

The power feed brushes 141 of the power feed members 14 maintain the contact with the electrodes 111 on both ends of the heat generating belt 11 in circumferential rotation so as to ensure power feed from the power supply 15 to the heat generating belt 11. Thus, in the heat generating belt 11, current flows through the resistance heating element layer 113, which is electrically coupled to the electrodes 111, and hence the heat generating belt 11 generates Joule heating based on the resistance value of the resistance heating element layer 113. As shown in FIG. 3, the temperature detection section 16, which detects the temperature of the outer surface of the heat generating belt 11, includes a thermistor, a thermopile, a multi-array thermopile, or another element disposed on the outer circumferential side of the heat generating belt 11. In particular, when the temperature detection section 16 is made up of a multi-array thermopile, only one unit of the multi-array thermopile is necessary to measure temperature at a plurality of locations. Additionally, the multi-array thermopile has a wide viewing angle for temperature detection, and this ensures a decreased number of multi-array thermopiles.

The fixing roller 12 with the core 13 as a shaft core is disposed inside the circumferential rotation passage of the heat generating belt 11. Thus, the fixing roller 12 presses the region 112 from the inside of the circumferential rotation passage of the heat generating belt 11 toward the outside of the circumferential rotation passage. As shown in FIG. 4, the fixing roller 12 includes a laminate of two elastic layers 121 and 122 on the outer surface of the core 13, which has a material with some heat resistance and strength. Examples of the core 13 include a metal material such as aluminum, iron, and stainless steel. The inner elastic layer 121 is made of a solid rubber layer such as of fluoro rubber and silicone rubber. The outer elastic layer 122 is made of a sponge rubber layer obtained by foaming, for example, fluoro rubber or silicone rubber.

That is, the elastic layer 121 with high density is covered with the elastic layer 122 made of a sponge rubber layer with low thermal conductivity. This suppresses heat transfer from the heat generating belt 11 to the fixing roller 12 and also ensures durability of the fixing roller 12. The fixing roller 12 preferably has a surface hardness lower than the surface hardness of the pressure roller 21, and preferably has Asker C hardness of 10° to 50°. The outer diameter of the fixing roller 12 is preferably approximately 10 mm to 50 mm. In this case, the elastic layers 121 and 122 each have a thickness in the range of 1 mm to 20 mm.

As shown in FIG. 4, the pressure roller 21, which constitutes the pressurizer 20, includes an elastic layer 23 and the release layer 24 deposited in this order on the outer surface of the core 22. The outer diameter of the pressure roller 21 is preferably approximately 20 mm to 40 mm. The core 22 is made of a metal material such as aluminum and iron. The thickness of the core 22 is preferably approximately 0.1 mm to 5 mm. The elastic layer 23 is made of an elastic material with some heat resistance, such as silicone rubber and silicone sponge. The thickness of the elastic layer 23 is preferably in the range of 1 mm to 20 mm. The release layer 24 is made of a material, such as fluorine tube, with some releasability, heat resistance, and gas barrier property. The thickness of the release layer 24 is preferably in the range of 5 μm to 100 μm.

The pressure roller 21 has a higher surface hardness than the surface hardness of the fixing roller 12, as described above. Hence, in the fixing nip region N1, the fixing roller 12 has a concave shape, while the pressure roller 21 has a convex shape. Based on the shape of the fixing roller 12 and the shape of the pressure roller 21 in the fixing nip region N1, a separation angle is ensured at the fixing roller 12 in the fixing nip region N1 on the downstream side in the conveyance direction.

A support structure for the heat generating belt 11 and the fixing roller 12, which constitute the heater 10, will be described below. As shown in FIGS. 6 and 7, support members respectively supporting the heat generating belt 11 and the fixing roller 12 are disposed on both ends of the heat generating belt 11 and both ends of the fixing roller 12. End restriction members 17 to hold the end portions of the heat generating belt 11 are disposed as the support members for the heat generating belt 11. The end restriction members 17 each include a ring-shaped rotary member 17*a* and a stationary member 17*b*. The ring-shaped rotary member 17*a* has a protruded outer circumference. The stationary member 17*b* has a protruded central region serving as an insertion portion into an opening portion 171 of the rotary member 17*a*. A bearing 19 is disposed as the support member for the fixing roller 12. The bearing 19 has a protruded central region serving as an insertion portion into an opening portion 181 of the stationary member 17*b* of the end restriction member 17.

The rotary member 17*a* of the end restriction member 17 includes a ring-shaped bottom plate portion 172 and a protruded portion 173. The ring-shaped bottom plate portion 172 is provided with the opening portion 171. The protruded portion 173 is made of a side wall vertically extending upward from the outer periphery of the bottom plate portion 172. The protruded portion 173 is disposed outside the opening portion 171, which is concentric to the protruded portion 173. The stationary member 17*b* includes a columnar portion (base portion) 182 and a columnar portion (base portion) 183. The columnar portion 182 has a wider bottom surface, while the columnar portion 183 has a narrower bottom surface. The columnar portion 182 and the columnar portion 183 are overlapped with each other into a coaxial shape. The opening portion 181 penetrates through the columnar portions 182 and 183. The opening portion 181 is disposed at a position with its center displaced with respect to the axes of the columnar portions 182 and 183.

With the rotary member 17*a* and the stationary member 17*b* thus configured, the columnar portion 183 of the stationary member 17*b* is inserted into the opening portion 171 of the rotary member 17*a* so as to constitute the end restriction member 17. Here, a surface 184 of the columnar portion 182, from which the columnar portion 183 is protruded, is brought into contact with the bottom plate portion 172, and the outer surface of the columnar portion 183 is brought into contact with the inner surface of the opening portion 171. Consequently, the rotary member 17*a* is rotatably supported with respect to the stationary member 17*b*. Here, the outer diameter of the heat generating belt 11 is set at a size that is identical to the inner diameter of the protruded portion 173 of the rotary member 17*a* or that is smaller than the inner diameter of the protruded portion 173 of the rotary member 17*a* by a clearance allowance. Also, the inner diameter of the opening portion 171 of the rotary member 17*a* is set at a size that is identical to the outer diameter of the columnar portion 183 of the stationary member 17*b* or that is larger than the outer diameter of the columnar portion 183 of the stationary member 17*b* by a clearance allowance.

The end restriction member 17, which is made up of the rotary member 17*a* and the stationary member 17*b*, restricts the position of the heat generating belt 11 at its side surface at the end portion of the heat generating belt 11 by a surface 174 of the bottom plate portion 172 of the rotary member 17*a*, from which the protruded portion 173 is protruded. The position of the heat generating belt 11 is restricted at its outer surface at the end portion of the heat generating belt 11 by the inner surface of the protruded portion 173 of the rotary member 17*a*. The rotary member 17*a* and the stationary member 17*b*, which constitute the end restriction member 17, are each made of a resin material such as polyimide resin, polyphenylene sulfide resin, polyether ether ketone resin, and liquid crystal polymer.

The bearing 19 includes a bearing portion 191, through which a shaft core of the core 13 of the fixing roller 12 is inserted. At one end surface of the bearing portion 191, a ring-shaped flange 192 expands on the outer periphery of the bearing portion 191. The bearing portion 191 of the bearing 19 is inserted into the opening portion 181 of the stationary member 17*b* of the end restriction member 17. Here, the flange 192 is brought into contact with a surface 185 of the columnar portion 182 of the stationary member 17b. Consequently, the bearing 19 pivotally supporting the fixing roller 12 at the bearing portion 191 is fixed by the end restriction member 17. The outer diameter of the bearing portion 191 is set at a size that is identical to the inner diameter of the opening portion 181 of the stationary member 17b or that is smaller than the inner diameter of the opening portion 181 of the stationary member 17*b* by a clearance allowance.

Figure 8:
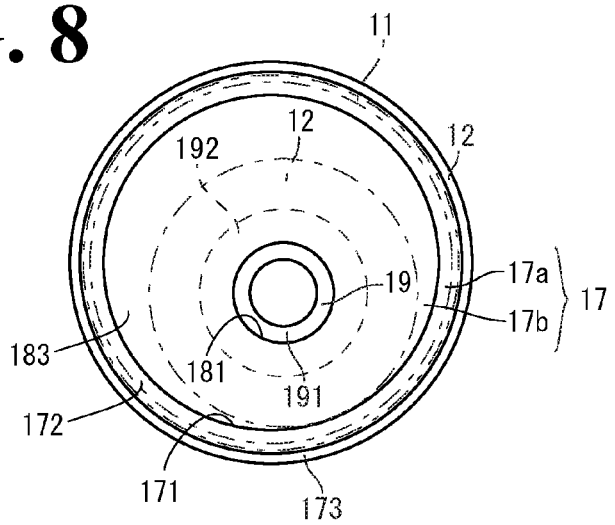
FIG. 8 is a diagram illustrating a relationship between an end restriction member and a bearing used for the fixing device shown in FIG. 3.

Description will be made with regard to a positional relationship between the heat generating belt 11 and the fixing roller 12, both ends of which are supported with the support structure made up of the end restriction member 17 and the bearing 19. As shown in FIG. 8, in the end restriction member 17, the center of the rotary member 17*a* corresponds to the center of the stationary member 17*b*, and the center of the protruded portion 173 of the rotary member 17*a* corresponds to the rotation center of the heat generating belt 11. The center of the opening portion 181 of the stationary member 17*b* is closer to the pressure roller 21 than to the rotation center of the heat generating belt 11, and is located on the downstream side in the conveyance direction of the recording sheet of paper P2. Accordingly, the rotation center of the fixing roller 12 pivotally supported by the bearing 19, which is fitted into the opening portion 181, is on the side of the pressure roller 21 and on the downstream side in the conveyance direction of the recording sheet of paper P2 with respect to the rotation center of the heat generating belt 11.

Figure 9:
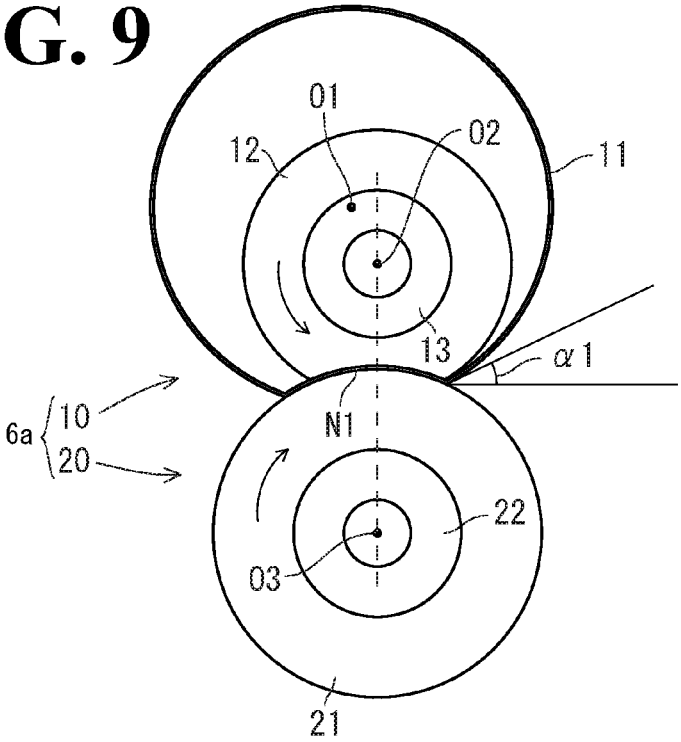
FIG. 9 is a schematic diagram illustrating a relationship between the heat generating belt, a fixing roller, and a pressure roller in the fixing device shown in FIG. 3.

Thus, with the fixing device 6*a* according to this embodiment, as shown in FIG. 9, the rotation center, O2, of the fixing roller 12 is located immediately above the rotation center, O3, of the pressure roller 21. The rotation center, O1, of the heat generating belt 11 is located at a position further away from the pressure roller 21 and on the upstream side in the conveyance direction of the recording sheet of paper P2 with respect to the rotation center O2 of the fixing roller 12. That is, the rotation center O1 of the heat generating belt 11 is located on a further upstream side in the conveyance direction of the recording sheet of paper P2 than a straight line connecting the rotation center O2 of the fixing roller 12 and the rotation center O3 of the pressure roller 21. Therefore, in the absence of pressure applied by the pressure roller 21, the inner surface of the heat generating belt 11 is brought into internal contact with the outer surface of the fixing roller 12 on a further downstream side in the conveyance direction of the recording sheet of paper P2 than the rotation center O1 of the heat generating belt 11.

Figure 10:
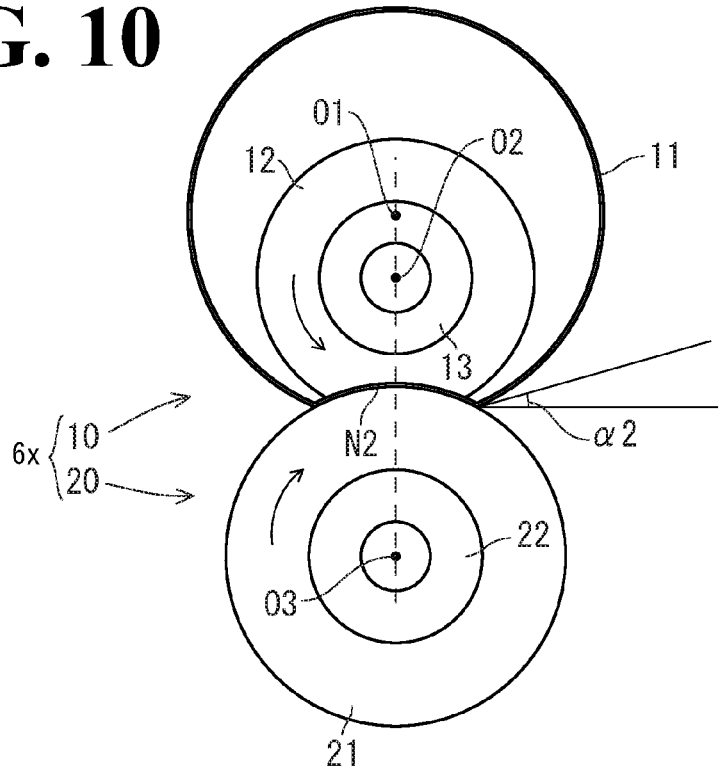
FIG. 10 is a schematic diagram illustrating a configuration of a fixing device for comparison with the configuration shown in FIG. 9.

With the heat generating belt 11 being in internal contact with the fixing roller 12 on the downstream side in the conveyance direction of the recording sheet of paper P2, the pressure roller 21, which is located immediately below the fixing roller 12, applies pressure to the heat generating belt 11 toward the fixing roller 12. This enlarges the space between the inner surface of the heat generating belt 11 and the outer surface of the fixing roller 12 on the upstream side of the fixing nip region N1, which results from the pressure applied by the pressure roller 21. On the downstream side of the fixing nip region N1, the inner surface of the heat generating belt 11 and the outer surface of the fixing roller 12 are in approximate contact with each other. For comparison with the configuration of the fixing device 6*a* shown in FIG. 9, FIG. 10 shows a configuration of a fixing device 6*x*. In the fixing device 6*x*, the rotation center O1 of the heat generating belt 11 is located on the straight line connecting the rotation center O2 of the fixing roller 12 and the rotation center O3 of the pressure roller 21.

A fixing nip region N2 in the fixing device 6*x* shown in FIG. 10 is symmetric with respect to the straight line connecting the rotation centers O2 and O3. Accordingly, the area of the space between the inner surface of the heat generating belt 11 and the outer surface of the fixing roller 12 on the upstream side of the fixing nip region N2 is the same as the area of the space between the inner surface of the heat generating belt 11 and the outer surface of the fixing roller 12 on the downstream side of the fixing nip region N2. Hence, a tangential direction of the heat generating belt 11 on the downstream side of the fixing nip region N2 (a nip outlet tangential direction) is inclined toward the paper ejection direction of the recording sheet of paper P2 with respect to a tangential direction of the fixing roller 12 at the same position.

A comparison will be made between the fixing device 6*x* shown in FIG. 10 and the fixing device 6*a* according to this embodiment. A comparison between the configurations on the upstream side of the fixing nip regions N1 and N2 respectively in the fixing devices 6*a* and 6*x* shows that the space between the heat generating belt 11 and the fixing roller 12 in the fixing device 6*a* is larger than the space between the heat generating belt 11 and the fixing roller 12 in the fixing device 6*x*. Accordingly, the contact length between the heat generating belt 11 and the fixing roller 12 on the upstream side of the fixing nip region N1 in the fixing device 6*a* is shorter than the contact length between the heat generating belt 11 and the fixing roller 12 on the upstream side of the fixing nip region N2 in the fixing device 6*x*. Thus, the fixing device 6*a* shortens the contact length on the upstream side of the fixing nip region N1, thereby minimizing heat transfer from the heat generating belt 11 to the fixing roller 12 on the upstream side of the fixing nip region N1. This eliminates or minimizes temperature drop of the heat generating belt 11 in the fixing nip region N1, and saves electric energy necessary for generating heat in the heat generating belt 11.

Additionally, the inclination angle (separation angle), $\alpha 1$, in the nip outlet tangential direction of the heat generating belt 11 on the downstream side of the fixing nip region N1 of the fixing device 6*a* with respect to the conveyance direction of the recording sheet of paper P2 is larger than the inclination angle (separation angle), $\alpha 2$, in the nip outlet tangential direction of the heat generating belt 11 on the downstream side of the fixing nip region N2 of the fixing device 6*x* with respect to the conveyance direction of the recording sheet of paper P2. Hence, the fixing device 6*a* improves separatability of the recording sheet of paper P2 on the downstream side of the fixing nip region N1 compared with the fixing device 6*x*. Furthermore, the heat generating belt 11 is in contact with the fixing roller 12 on the downstream side of the fixing nip region N1, and thus the heat generating belt 11 is kept in held state between the power feed member 14 and the fixing roller 12 as shown in FIGS. 3 and 4. This ensures a satisfactory contact state between the electrodes 111 of the heat generating belt 11 and the power feed brushes 141 of the power feed members 14, thereby improving the power feed stability of the heat generating belt 11 and also reducing its contact resistance.

Figure 11:
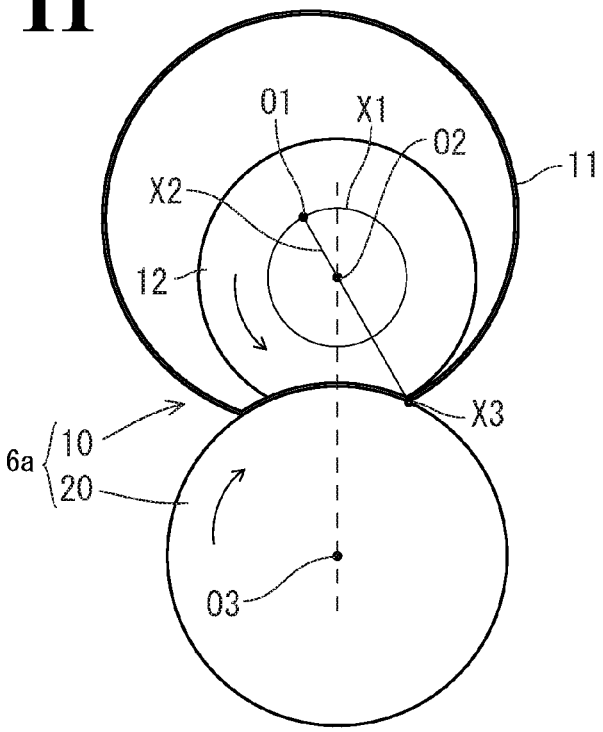
FIG. 11 is a schematic diagram illustrating a relationship between the rotation center of the heat generating belt and the rotation center of the fixing roller in the fixing device shown in FIG. 3.

In the fixing device 6*a* according to this embodiment, the position of the rotation center O1 of the heat generating belt 11 is preferably the position of the intersection of a circle X1 around the rotation center O2 of the fixing roller 12 and a straight line X2 passing through the rotation center O2 as shown in FIG. 11. The circle X1 has a diameter identical to the difference between the inner diameter of the heat generating belt 11 and the outer diameter of the fixing roller 12. The circle X1 indicates a locus of the rotation center O1 in implementing the internal contact of the fixing roller 12 with the heat generating belt 11. The straight line X2 is the straight line connecting the rotation center O2 and an intersection X3 of the fixing roller 12 and the pressure roller 21 on the downstream side of the conveyance direction of the recording sheet of paper P2. The rotation center O1 is located at one of the two intersections of the circle X1 and the straight line X2. The one intersection is further away from the intersection X3, and this ensures optimal setting of the fixing nip region N1.

<Second Embodiment>

Figure 12:
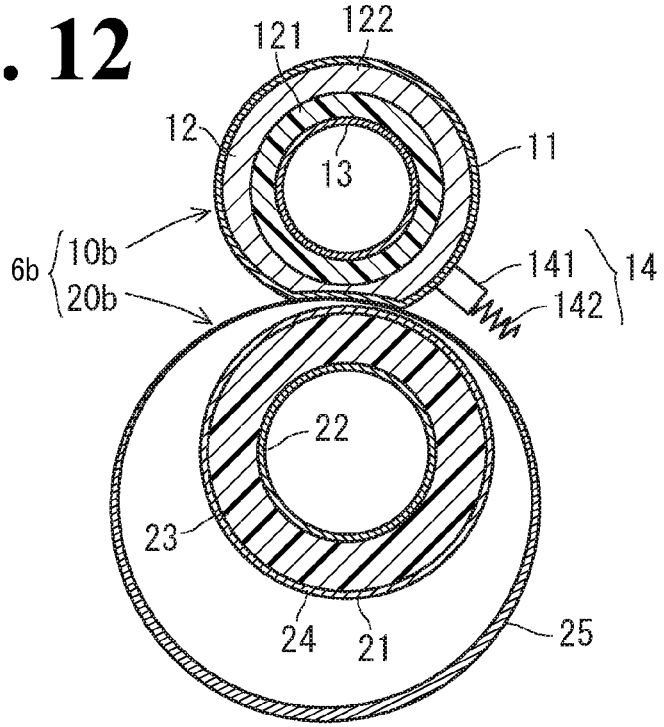
FIG. 12 is a schematic cross-sectional view of the fixing device in the image forming apparatus according to the first embodiment.

An image forming apparatus according to a second embodiment will be described below with reference to the drawings, with a configuration of the fixing device in focus. FIG. 12 is a schematic cross-sectional view of the fixing device in the image forming apparatus according to this embodiment. In the configuration shown in FIG. 12, the same reference numerals have been used for components having the same configurations as in FIGS. 3 and 4, and these components will not be elaborated here.

As shown in FIG. 12, the fixing device 6*b* of this embodiment includes a heater 10*b* and a pressurizer 20*b*. The heater 10*b* is made up of a heat generating belt 11 and a fixing roller 12. The pressurizer 20*b* is made up of a pressure roller 21 and a pressure belt 25. The heater 10*b* in the fixing device 6*b* according to this embodiment is different from the heater 10 according to the first embodiment (see FIG. 4) in that the inner diameter of the heat generating belt 11 is approximately identical to the outer diameter of the fixing roller 12, and that the entire outer surface of the fixing roller 12 is covered with the heat generating belt 11. Similarly to the first embodiment, the heat generating belt 11 is brought into contact with power feed members 14 so as to generate heat upon receipt of power feed from a power supply 15 (see FIG. 4). The pressurizer 20*b* rotates the pressure belt 25 by the pressure roller 21, similarly to the pressurizer 20 according to the first embodiment (see FIG. 4). The pressure belt 25 corresponds to the "fixing belt" recited in the appended claims. The pressure roller 21 and the fixing roller 12 respectively correspond to the "first fixing roller" and the "second fixing roller" recited in the appended claims.

Figure 13:
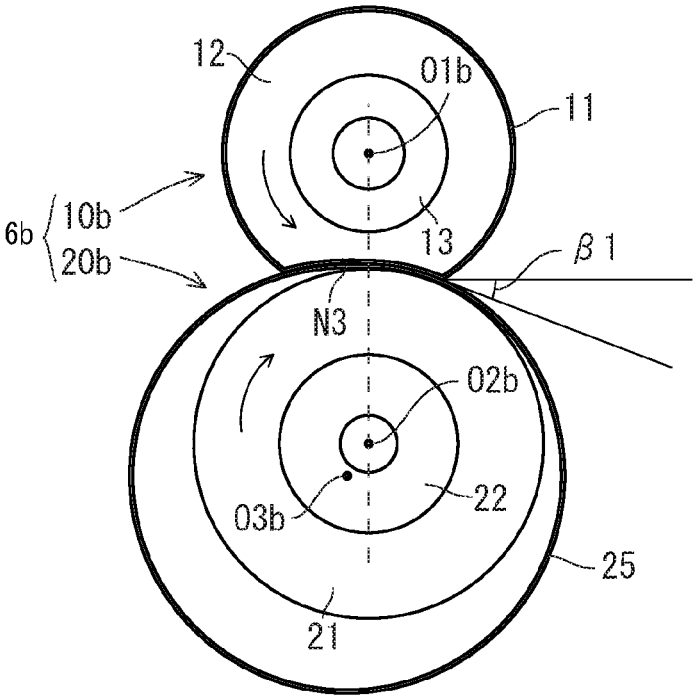
FIG. 13 is a schematic diagram illustrating a relationship between a press belt, the fixing roller, and the pressure roller in the fixing device shown in FIG. 12.
Figure 14:
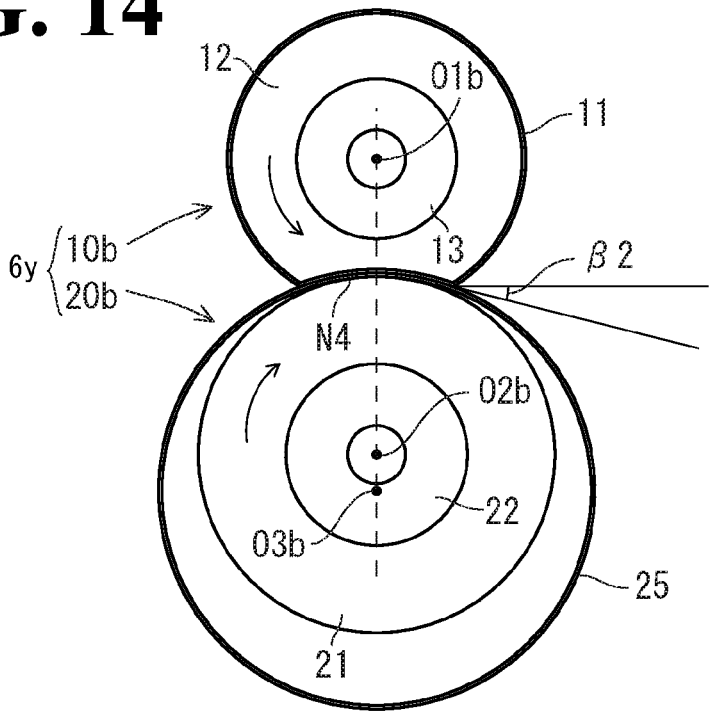
FIG. 14 is a schematic diagram illustrating a configuration of a fixing device for comparison with the configuration shown in FIG. 13.

In the fixing device 6*b* thus configured, the heat generating belt 11 and the fixing roller 12, which constitute the heater 10*b*, rotate about a common rotation center O1*b* as shown in FIG. 13. In the pressurizer 20*b*, a rotation center O2*b* of the pressure roller 21 is located immediately below the rotation center O1*b* of the heat generating belt 11 and the fixing roller 12. A rotation center O3*b* of the pressure belt 25 is located closer to the heater 10*b* and on a further upstream side in the conveyance direction of the recording sheet of paper P2 than the rotation center O2*b*. Here, both ends of each of the pressure roller 21 and the pressure belt 25, which constitute the pressurizer 20*b*, are rotatably supported by the same support mechanism as the end restriction member 17 and the bearing 19 (see FIGS. 7 and 8) described in the first embodiment.

The fixing device 6*b* is different from the fixing device 6*a* according to the first embodiment in that the rotation center O3*b* of the pressure belt 25 of the pressurizer 20*b* is located on an upstream side in the conveyance direction of the recording sheet of paper P2 with respect to a straight line connecting the rotation center O1*b* of the fixing roller 12 and the rotation center O2*b* of the pressure roller 21. This enlarges the space between the outer surface of the pressure roller 21 and the inner surface of the pressure belt 25 in the fixing device 6*b* on the upstream side of a fixing nip region N3, which is defined by the heat generating belt 11 and the pressure belt 25. The outer surface of the pressure roller 21 is in internal contacted with the inner surface of the pressure belt 25 on the downstream side of the fixing nip region N3. That is, the configuration of the pressurizer 20*b* of the fixing device 6*b* is similar to the configuration of the heater 10 of the fixing device 6*a* according to the first embodiment.

A Comparison will be made between the fixing device 6*b* *and* a fixing device 6*y*, in which the rotation center 03*b* of the pressure belt 25 is located on the straight line connecting the rotation center O1*b* of the fixing roller 12 and the rotation center 02*b* of the pressure roller 21. A separation angle, $\beta 1$, of the pressure belt 25 on the downstream side of the fixing nip region N3 in the fixing device 6*b* is larger than a separation angle, $\beta 2$, of the pressure belt 25 on the downstream side of a fixing nip region N4 in the fixing device 6*y*. Hence, the fixing device 6*b* improves the separatability of the recording sheet of paper P2 on the downstream side of the fixing nip region N3 compared with the fixing device 6*y*.

Additionally, in the fixing device 6*b*, the pressure roller 21 has less of contact with the pressure belt 25 on the upstream side of the fixing nip region N3, and the separation angle β1 of the pressure belt 25 increases on the downstream side of the fixing nip region N3. This eliminates or minimizes poor separation even when remelting occurs in a toner image fixed to a rear surface during duplex printing.

The fixing device 6*b* according to this embodiment employs the heater 10*b*, in which the entire outer surface of the fixing roller 12 is covered with the heat generating belt 11. Similarly to the first embodiment, the fixing device 6*b* may include the heater 10, in which the rotation center of the heat generating belt 11 is located on the further upstream side in the conveyance direction of the recording sheet of paper P2 than the rotation center of the fixing roller 12. In this case, the rotation center of the heat generating belt 11 and the rotation center of the pressure belt 25 are located on the upstream side in the conveyance direction of the recording sheet of paper P2 with respect to the straight line connecting the rotation center of the fixing roller 12 and the rotation center of the pressure roller 21.

In the above-described embodiments, the heat generating belt with a resistance heating element to receive power has been exemplified as the heating mechanism of the heater for the fixing device. This, however, should not be construed in a limiting sense. For example, the fixing belt pressed toward the pressurizer by a fixing pad disposed inside the fixing belt may be heated by a halogen heater, an induction heating coil, a ceramic heater, or another heater.

Figure 15:
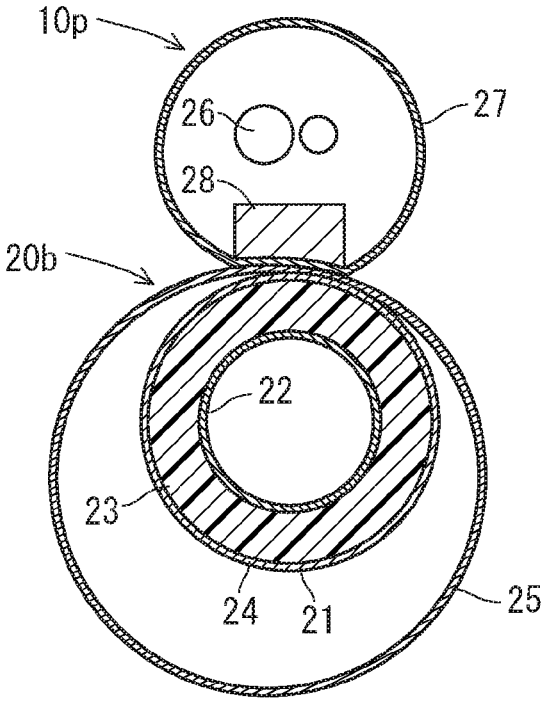
FIG. 15 is a schematic cross-sectional view of a fixing device of another configuration according to a second embodiment.
Figure 16:
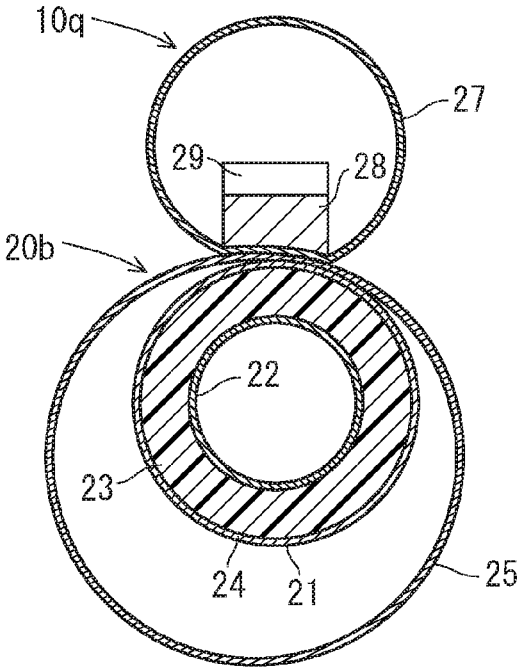
FIG. 16 is a schematic cross-sectional view of a fixing device of another configuration according to the second embodiment.

Specifically, as shown in FIG. 15, in the fixing device 6*b* according to the second embodiment, a heater 10*p* may include a fixing belt 27 and a fixing pad 28. The fixing belt 27 incorporates a halogen heater 26. The fixing pad 28 presses the fixing belt 27 from the inside of the fixing belt 27 toward the pressurizer 20*b*. In another embodiment shown in FIG. 16, a heater 10*q* has such a configuration that the fixing belt 27 incorporating the fixing pad 28 is heated by a ceramic heater 29 disposed on a side of the fixing pad 28 opposite the pressurizer 20*b*.

Figure 17:
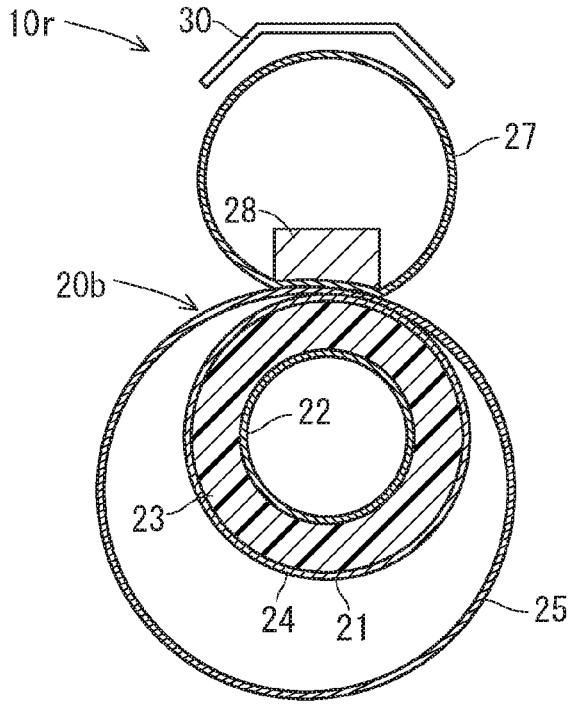
FIG. 17 is a schematic cross-sectional view of a fixing device of another configuration according to the second embodiment.
Figure 18:
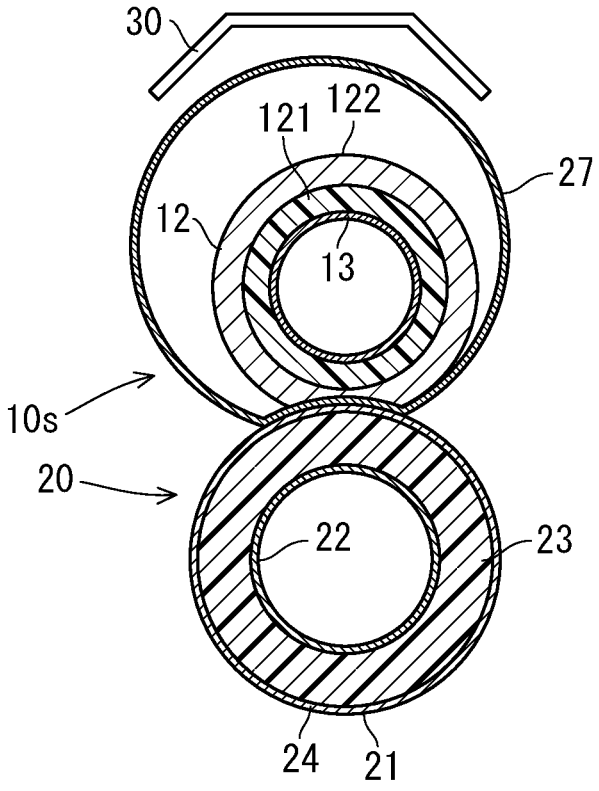
FIG. 18 is a schematic cross-sectional view of a fixing device of another configuration according to the first embodiment.

In still another embodiment shown in FIG. 17, a heater 10*r* includes the fixing belt 27 and an induction heating coil 30. The fixing belt 27 incorporates the fixing pad 28. The induction heating coil 30 is disposed on the outer periphery of the fixing belt 27. A heat generating layer of the fixing belt 27 generates heat with a magnetic flux generated from the induction heating coil 30 by electromagnetic induction so as to heat the fixing belt 27. In yet another embodiment shown in FIG. 18, as a modification of the fixing device 6*a* of the first embodiment, a heater 10*s* includes the fixing belt 27 and the induction heating coil 30 instead of the heating belt 11 and the power feed member 14 in the heater 10*a* shown in FIG. 4.

Insofar as any of the fixing devices according to the above-described embodiments is provided, the image forming apparatus may be an MFP (Multifunction Peripheral) having a copying function, a scanner function, a printer function, and a facsimile function. Alternatively, the image forming apparatus may be, for example, a printer, copying machine, or facsimile. In other respects, the configurations of the individual components are not limited to those in the embodiments shown in the drawings, and various changes may be made without departing from the scope of the present invention.

With the embodiment, the rotation center of the fixing belt is shifted with respect to the rotation center of the first fixing roller in the recording-paper conveyance direction. This ensures a large inclination angle (separation angle) of the fixing belt in the tangential direction on the downstream side of the fixing nip region with respect to the recording-paper conveyance direction. This eliminates or minimizes the difficulty in separating the recording sheet of paper past the fixing nip region.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fixing device comprising:

a rotatable fixing belt;

a first fixing roller in internal contact with an inner surface of the fixing belt, the first fixing roller comprising an outer diameter smaller than an inner diameter of the fixing belt;

a second fixing roller in external contact with an outer surface of the fixing belt, the second fixing roller holding the fixing belt against the first fixing roller so as to define a fixing nip region between the first fixing roller and the second fixing roller;

an end restriction member supporting ends of the fixing belt so as to restrict a rotation position of the fixing belt; and a support member disposed at a position in the end restriction member to pivotally support the first fixing roller, the position being shifted with respect to a center position of the end restriction member corresponding to a rotation center of the fixing belt, wherein the rotation center of the fixing belt is shifted toward a recording-paper conveyance direction of the fixing nip region with respect to a straight line connecting a rotation center of the first fixing roller and a rotation center of the second fixing roller to each other in a direction orthogonal to a rotation axis of the first fixing roller and a rotation axis of the second fixing roller.

2. The fixing device according to claim 1, wherein the rotation center of the fixing belt is shifted toward an upstream side in the recording-paper conveyance direction with respect to the straight line connecting the rotation center of the first fixing roller and the rotation center of the second fixing roller to each other in the direction orthogonal to the rotation axis of the first fixing roller and the rotation axis of the second fixing roller.

3. The fixing device according to claim 1, wherein the end restriction member comprises a rotary member rotatable in conjunction with the fixing belt, and a stationary member pivotally supporting the rotary member and fitted with the support member.

4. The fixing device according to claim 1, further comprising a heating mechanism configured to heat the fixing belt, the heating mechanism comprising:

a heater comprising the fixing belt and the first fixing roller; and a pressurizer comprising the second fixing roller.

5. The fixing device according to claim 4, wherein the fixing belt comprises a resistance heating element comprising electrodes on ends of the resistance heating element and being electrically coupled to the electrodes, wherein the heating mechanism comprises the resistance heating element and the electrodes of the fixing belt, and a power feed member in contact with the electrodes of the fixing belt, and wherein the power feed member is configured to feed power to the resistance heating element of the fixing belt so as to cause the fixing belt to generate heat.

6. The fixing device according to claim 1, further comprising:

a pressurizer comprising the fixing belt and the first fixing roller; and a heater comprising the second fixing roller.

7. An image forming apparatus comprising:

a transfer unit configured to transfer a toner image onto a recording sheet of paper; and a fixing unit configured to heat and press the recording sheet of paper with the toner image transferred to the recording sheet of paper by the transfer unit, the fixing unit comprising the fixing device according to claim 1.

8. The image forming apparatus according to claim 7, wherein the rotation center of the fixing belt is shifted toward an upstream side in the recording-paper conveyance direction with respect to the straight line connecting the rotation center of the first fixing roller and the rotation center of the second fixing roller to each other in the direction orthogonal to the rotation axis of the first fixing roller and the rotation axis of the second fixing roller.

9. The image forming apparatus according to claim 7, wherein the end restriction member comprises a rotary member rotatable in conjunction with the fixing belt, and a stationary member pivotally supporting the rotary member and fitted with the support member.

10. The image forming apparatus according to claim 7, further comprising a heating mechanism configured to heat the fixing belt, the heating mechanism comprising:

a heater comprising the fixing belt and the first fixing roller; and a pressurizer comprising the second fixing roller.

11. The image forming apparatus according to claim 10, wherein the fixing belt comprises a resistance heating element comprising electrodes on ends of the resistance heating element and being electrically coupled to the electrodes, wherein the heating mechanism comprises the resistance heating element and the electrodes of the fixing belt, and a power feed member in contact with the electrodes of the fixing belt, and wherein the power feed member is configured to feed power to the resistance heating element of the fixing belt so as to cause the fixing belt to generate heat.

12. The image forming apparatus according to claim 7, further comprising:

a pressurizer comprising the fixing belt and the first fixing roller; and a heater comprising the second fixing roller.

* * * * *